United States Patent [19]

Ito et al.

[11] 4,229,157

[45] Oct. 21, 1980

[54] SYSTEM FOR CONTROLLING FEED OF WASTE GAS TO GROUND FLARE

[75] Inventors: Takusen Ito; Masami Murakami, both of Osaka; Eizo Ishikawa; Keiichi Otsuka, both of Ibaraki, all of Japan

[73] Assignee: Hitachi Shipbuilding & Engineering Company Limited, Osaka, Japan

[21] Appl. No.: 942,769

[22] Filed: Sep. 15, 1978

[30] Foreign Application Priority Data

Oct. 4, 1977 [JP] Japan ..... 52-119850

[51] Int. Cl.[3] ..... F23D 13/20

[52] U.S. Cl. ..... 431/90; 431/5; 431/12; 431/61; 431/202

[58] Field of Search ..... 431/89, 90, 202, 61, 431/4–6, 175, 178–181, 187, 188, 12, 350

[56] References Cited

U.S. PATENT DOCUMENTS

| | | | |
|---|---|---|---|
| 2,971,605 | 2/1961 | Frost et al. | 183/6 |
| 3,322,178 | 5/1967 | Nahas | 158/7 |
| 3,749,546 | 7/1973 | Reed et al. | 431/5 |
| 3,779,689 | 12/1973 | Reed et al. | 431/89 |
| 4,059,385 | 11/1977 | Gulitz et al. | 431/12 |
| 4,065,247 | 12/1977 | Okigami et al. | 431/202 |
| 4,087,235 | 5/1978 | Ito et al. | 431/174 |

FOREIGN PATENT DOCUMENTS

| | | | |
|---|---|---|---|
| 1111358 | 4/1968 | United Kingdom | 431/5 |

*Primary Examiner*—Robert S. Ward, Jr.

[57] ABSTRACT

A conduit for feeding a combustible waste gas to a ground flare is divided into a plurality of branch pipes each connected to burners of the ground flare. A stop valve is mounted on each of the branch pipes except the first pipe and provided with a limit switch for detecting the closing of the valve. A pressure detector is mounted on each of the branch pipes except the last pipe. The valve on each branch pipe opens in response to an opening signal from the pressure detector on the preceding branch pipe and closes in response to both a closing signal from that pressure detector and a signal from the limit switch on the valve on the following branch pipe, whereby the number of branch pipes used for feeding the waste gas is controlled in accordance with variations in the feed of waste gas.

7 Claims, 5 Drawing Figures

SYSTEM FOR CONTROLLING FEED OF WASTE GAS TO GROUND FLARE

The present invention relates to a ground flare for burning combustible waste gases, and more particularly to a system for controlling the feed of waste gas to the flare.

Combustions gases discharged for example from oil refineries, petrochmical plants, etc. are burned in ground flares and released to the atmosphere. Ground flares, which are generally subjected to marked variations in load, require a system for controlling the feed of waste gas. Such control systems heretofore used comprise a plurality of branch pipes branching from a waste gas conduit and connected to the burners of the ground flare, valves each mounted on each of the branch pipes other than the first pipe, and gas pressure detectors mounted respectively on the branch pipes other than the last pipe and set at progressively varying pressure values for opening or closing the valves, such that the valve on each branch pipe is opened or closed in response to a signal from the pressure detector on the preceding branch pipe to open or close the branch pipes in a stepwise manner in accordance with the pressure (flow rate) of the waste gas.

These control systems have the drawback that when subjected to an excessive or abrupt variation of load, two or more valves open or close at the same time, giving rise to difficulties in the combustion of the gas. Another drawback of the control systems is that the quantity of waste gas thereby handled is limited as will be fully understood from the description to follow.

The main object of the present invention, which has been accomplished in view of these drawbacks, is to provide a control system for a ground flare including valves which open or close stepwise free of any trouble even when subjected to an excessive or abrupt variation of load.

Another object of this invention is to provide a control system capable of handling large quantities of waste gas.

To fulfil these objects, this invention provides a control system of the type described in which a valve mounted on each of the branch pipes is provided with means for detecting the closing of the valve so as to be closable in response to both a signal from the pressure detector on the preceding branch pipe and a signal from the valve closing detecting means on the following branch pipe.

According to the preferred embodiment of this invention, the pressure detecting means mounted on the branch pipes are all set at substantially the same pressure value for emitting a valve opening or closing signal. This enables the branch pipes to have a definite maximum flow rate irrespective of the number of open branch pipes, rendering the system easy to design and steadily operable.

Various other features and advantages of this invention will become more apparent from the following detailed description of the preferred embodiment with reference to the accompanying drawings, in which.

Figure 1:
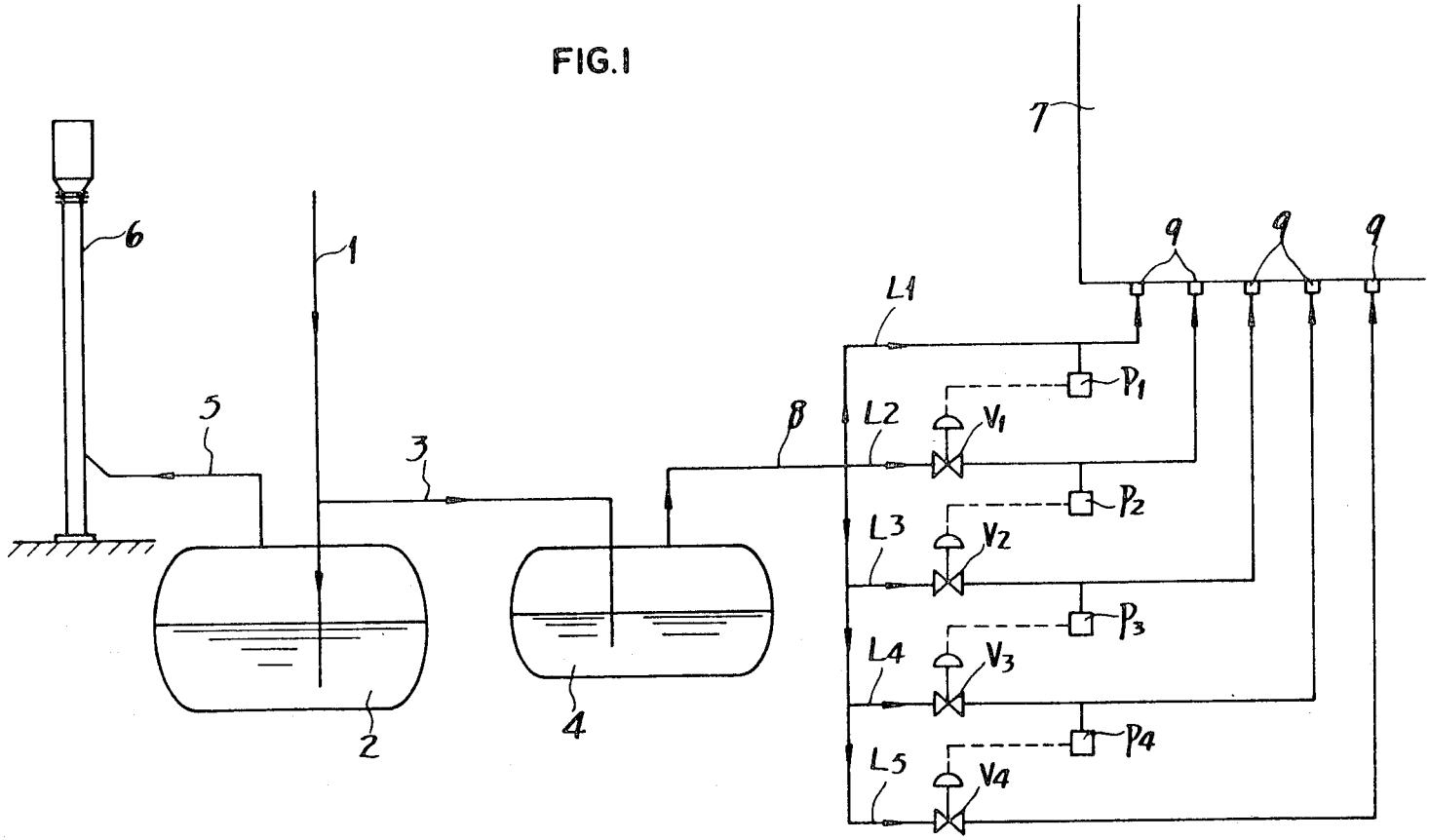
FIG. 1 is a diagram showing a conventional system for controlling the feed of waste gas to a ground flare.
Figure 5:
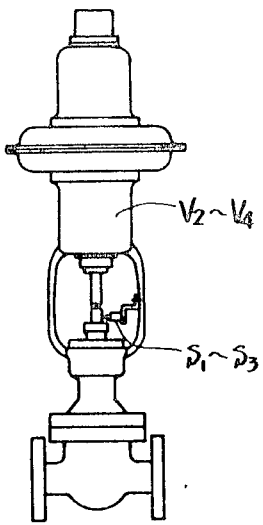
FIG. 5 is a front view showing a valve.

For a better understanding of the features of the present invention, a system heretofore used for controlling the feed of waste gas to a ground flare and its operation as well as apparatus associated therewith will be described first with reference to FIGS. 1 and 2.

Combustible waste gas discharged from a refinery, petrochemical plant or like chemical plant is led through a main duct 1 to a first water seal drum 2. Since the forward end of the main duct 1 is watersealed in the drum 2, the gas, when having pressure of up to a specified level, is introduced into a second water seal drum 4 by way of a gas conduit 3 branching from the main duct 1 and adapted to feed the gas to a ground flare 7. The waste gas pressure, if higher than the specified level, breaks the water seal of the first drum 2, and an excess of the waste gas larger than the capacity of the ground flare is led out from the first drum 2 through a conduit 5 to a flare stack 6, where it is burned.

The depth of the water seal in the first drum 2 is usually up to 1,000 mm for the following two reasons.

(1) When breaking the water seal, the waste gas fluctuates the liquid level. The fluctuations become more pronounced with an increase in the depth of the water seal, disturbing the steady flow of waste gas to the flare stack and also to the ground flare and producing pulsating combustion.

(2) The increase in the depth of the water seal presents increasing difficulty in the release of the waste gas from the plant.

The water seal in the second water seal drum 4 usually has a depth of 50 to 200 mm since it needs only to have a depth sufficient to prevent backfire. It therefore follows that the upper limit of the pressure of the waste gas to be led from the second drum 4 to the ground flare 7 is the maximum depth of water seal in the first drum 2, 1,000 mm, minus the depth of water seal in the second drum 4, 50 to 200 mm, namely 800 to 950 mm.

The waste gas passing through the second drum 4 is led through a conduit 8 to a plurality of burner means 9 of the ground flare 7. Since the amount of waste gas to be discharge from the main duct 1, accordingly the amount of waste gas to be fed to the ground flate 7 via the conduit 8, generally varies greatly, there is the necessity of using a system for controlling the feed of waste gas in accordance with the variations in order to ensure trouble-free combustion even when the load varies abruptly.

Such a control system is known which comprises a plurality of branch pipes $L_1$, $L_2$, $L_3$, $L_4$, $L_5$ branching from the conduit 8 and connected to the burner means 9 of the ground flare 7 respectively, valves $V_1$, $V_2$, $V_3$, $V_4$ mounted on the second to fifth branch pipes $L_2$–$L_5$, and gas pressure detectors $P_1$, $P_2$, $P_3$, $P_4$ mounted on the first to fourth branch pipes $L_1$–$L_4$ as shown in FIG. 1. The valves are opened or closed in response to signals from the pressure detectors to accommodate variations in the amount of waste gas.

The lower limit of the pressure of waste gas to be introduced into the burner means 9 must be 64 mm head since soot will result from insufficient mixture of gas and air if the feed of waste gas to the burner means reduces to a lower level (see U.S. Pat. No. 3,749,546).

Accordingly the valves $V_1$, $V_2$, $V_3$, $V_4$ are so controlled that the pressure of the waste gas to be introduced to the burner means 9 is within the range of 950 to 64 mm head. The detectors $P_1$ $P_4$ are set at different pressure values for opening or closing the valves so that the valves will not open or close at the same time but operate stepwise.

Since the pressure of gas through the first branch pipe $L_1$ will invariably increase from 0 mm head, formation of soot or pulsating combustion due to unstable flames is inevitable at pressures below the lower limit (64 mm head). Thus there is the necessity of reducing the combustion with the burner means connected to the branch pipe $L_1$ to such an extent that pulsating combustion, even if taking place, will not produce any problem. The extent of such reduced combustion is up to 13% of the capacity of the ground flare.

Figure 2:
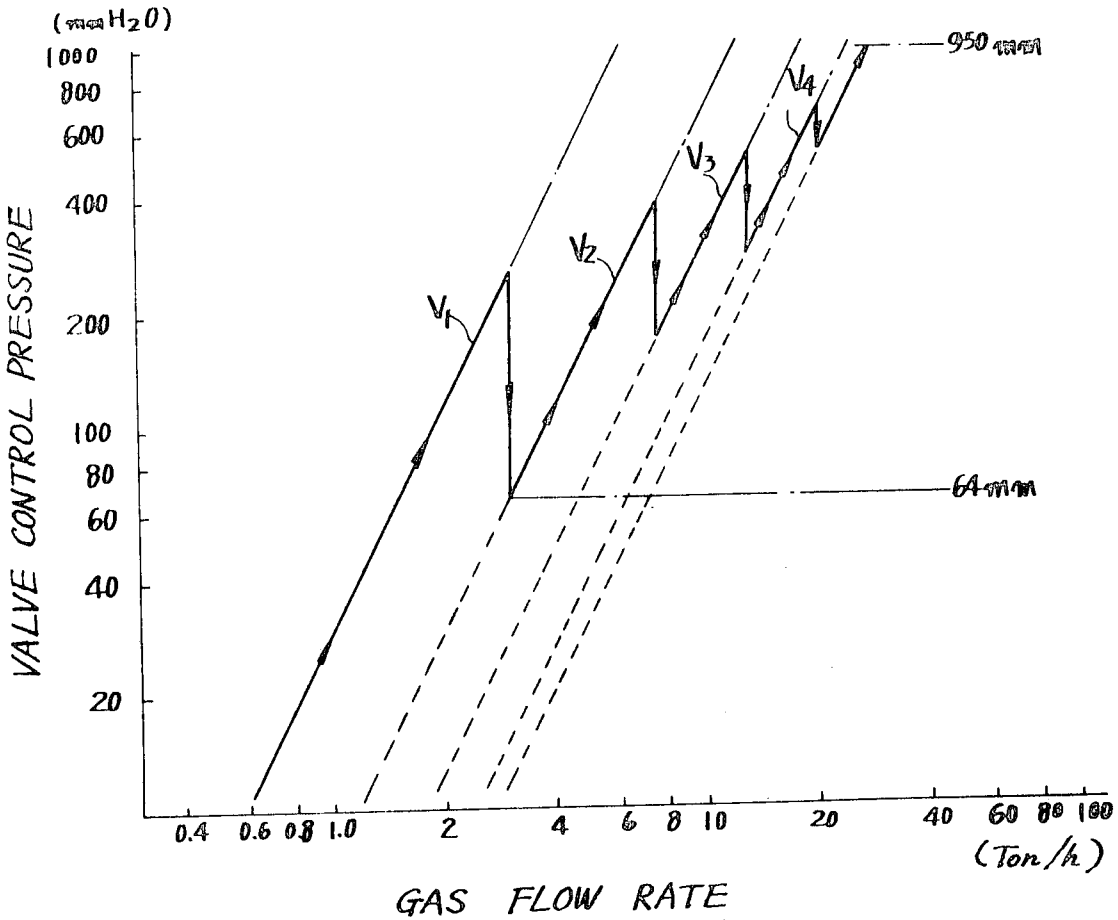
FIG. 2 is a graph showing the relation between the gas flow rate and the valve controlling pressure in the conventional system.

With the conventional control system described above in details, the range of pressure settings for opening and closing a valve relative to the pressure of the gas fed to the valve reduces from valve to valve as is apparent from FIG. 2, with the result that substantial difficulty arises in the operation of the fifth valves et. seq. The narrow range of control pressure settings limits the quantity of the gas to be handled by each valve. Furthermore marked variations in load could take place in excess of the capacity of the system, in which case two or more valves would be opened or closed at the same time, consequently disturbing the control on the feed of waste gas and presenting difficulty in the combustion of gas.

Figure 3:
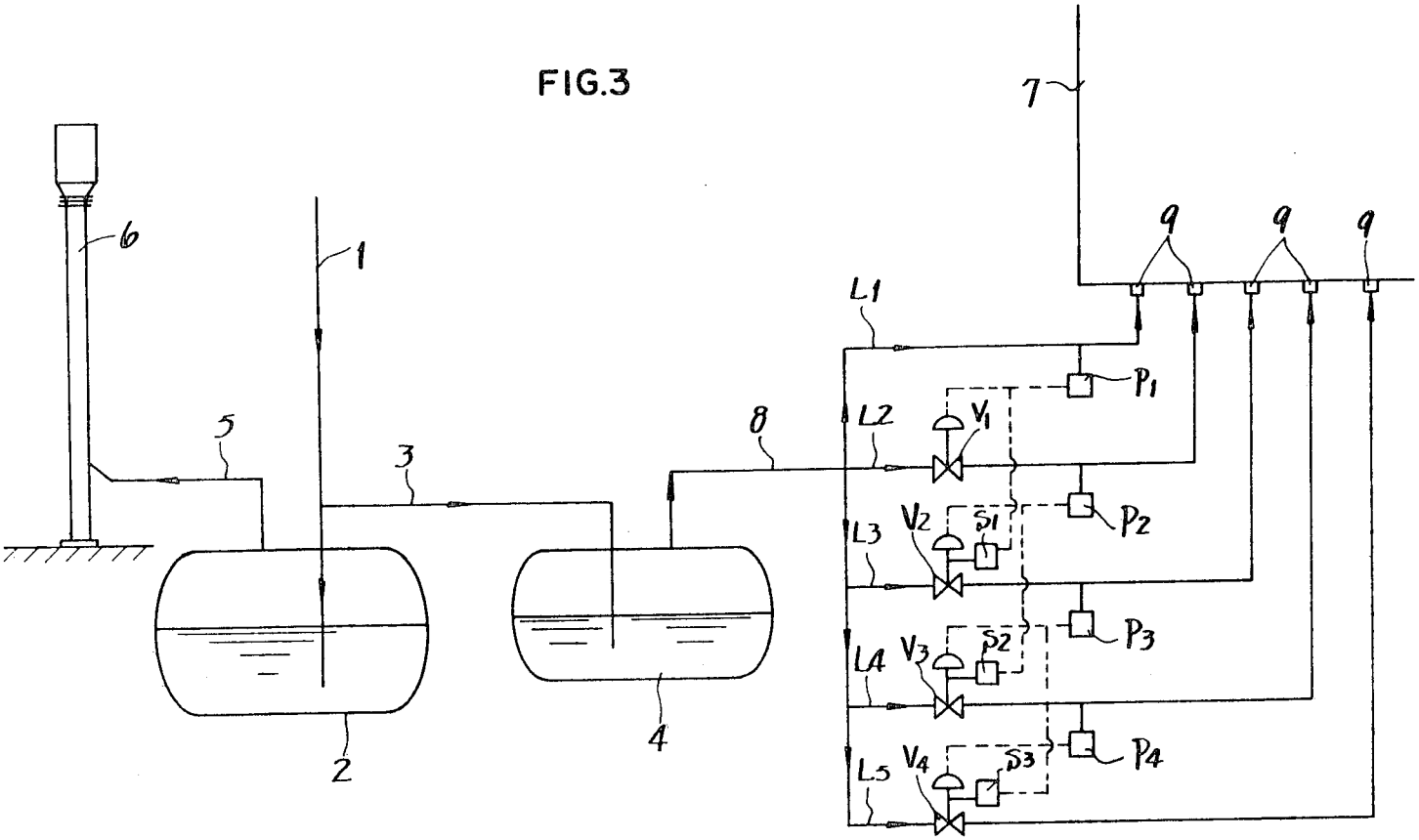
FIG. 3 is a diagram showing a system for controlling the feed of waste gas embodying this invention.
Figure 4:
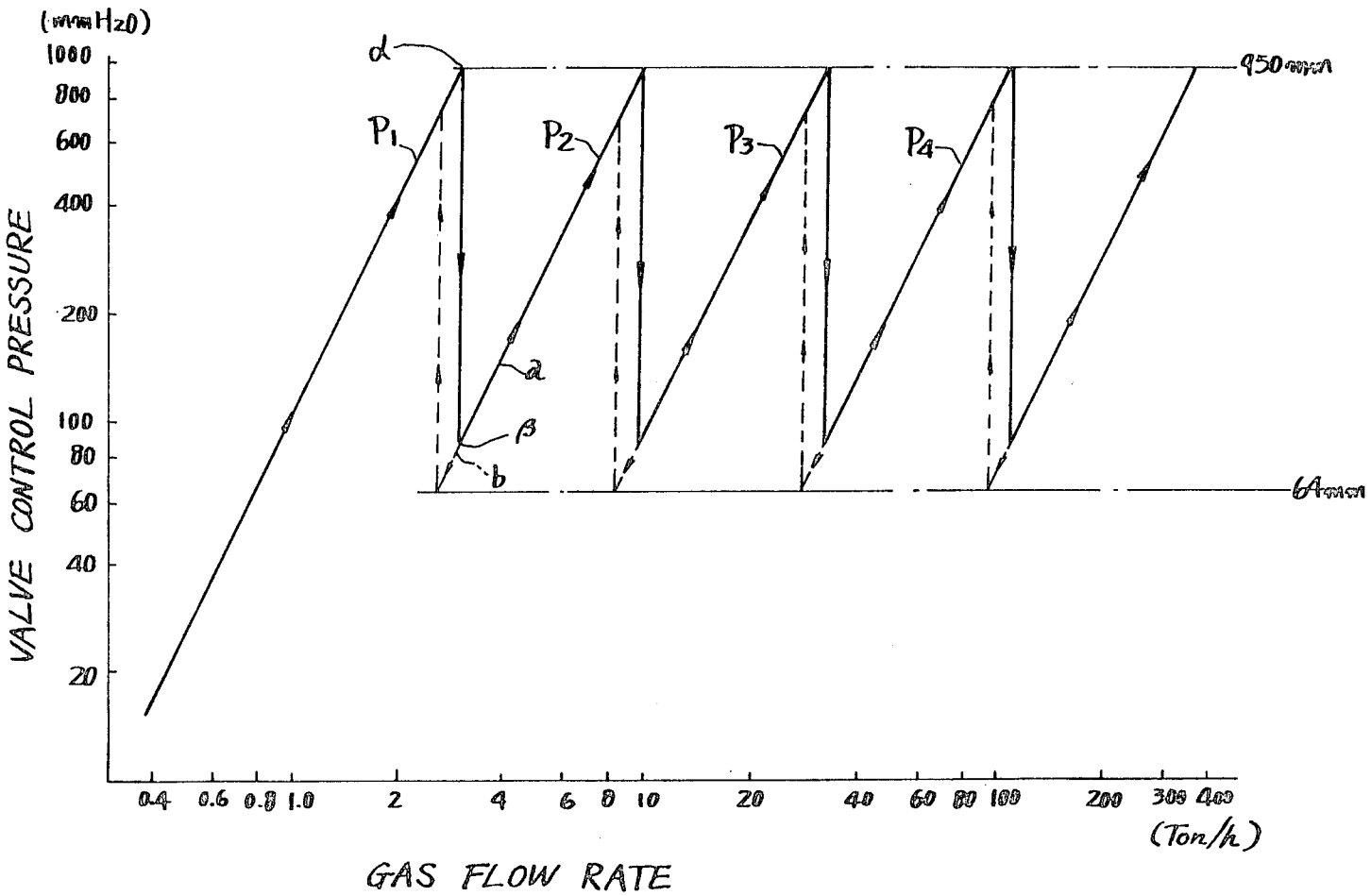
FIG. 4 is a graph showing the relation between the gas flow rate and the valve controlling pressure in the embodiment of this invention.

With reference to FIGS. 3 and 4, a system of this invention will be described below for controlling the feed of waste gas free of the foregoing drawbacks. Throughout the drawings, like parts are referred to by like reference numerals. FIG. 3 shows branch pipes $L_1$, $L_2$, $L_3$, $L_4$, $L_5$ branching from a waste gas conduit 8 and respectively connected to the burner means 9 of a ground flare 7. Valves $V_1$, $V_2$, $V_3$, $V_4$ to be opened and closed stepwise are mounted on the branch valves $L_2$, $L_3$, $L_4$, $L_5$, except the first branch pipe. Except for the last branch pipe $L_5$, the branch pipes are provided with gas pressure detectors $P_1$, $P_2$, $P_3$, $P_4$ each adapted to detect the pressure of gas through the pipe concerned and feeding the resulting signal to the valve on the following branch pipe. The system of this invention is the same as the conventional system with respect to the construction described above. According to the present invention, however, the valves $V_2$, $V_3$, $V_4$ are provided with limit switches $S_1$, $S_2$, $S_3$ respectively for detecting the movement of the valve stem concerned, namely for detecting the closing of the valve. Thus each of the valves is adapted to be closed in response to both a pressure signal from the detector on the preceding pipe and a valve closing signal from the limit switch on the following pipe. Further according to this invention, the gas pressure detectors are all set at substantially the same pressure value for emitting a valve closing or opening signal. In addition, the number of the burners included in the burner means 9 connected to the branch pipes increases from pipe to pipe so that the amount of gas to be handled increases from pipe to pipe in the manner of geometric progression.

FIG. 4 shows the operation of the valves according to this invention. The valves are opened one after another with increasing flow rate of the gas as in the conventional system, such that the valve on each branch pipe is opened in response to a pressure signal from the detector on the preceding pipe as indicated in the slid line in FIG. 4.

The valves will be closed with decreasing gas flow rate in the following manner. As the gas flow rate reduces, the detector $P_4$ on the fourth branch pipe $L_4$ detects the reduction of the pressure to the setting thereon or to a lower level and emits a signal to the valve $V_4$ on the fifth branch pipe $L_5$.

In response to the pressure signal, the valve $V_4$ closes. This results in a rise in the gas pressure. The limit switch $S_3$ on the valve $V_4$ detects the closing of the valve $V_4$ and gives a valve closing signal to the valve $V_3$ on the fourth branch pipe $L_4$. With a further reduction in the gas flow rate, the detector $P_3$ on the third branch pipe $L_3$ detects that the pressure of gas through the pipe has reduced to the setting thereon or lower and emits a signal to the valve $V_3$ on the fourth branch pipe $L_4$. Thus the valve on the fourth branch pipe $L_4$ closes for the first time in response to both the pressure signal from the detector on the preceding pipe and the valve closing signal from the limit switch on the following branch pipe. The valves $V_2$, $V_1$ on the third and second branch pipes are thereafter controlled in the same manner as above. Since the valves are controlled in this way, the valve on each branch pipe will not be closed unless the valve on the following branch pipe is closed. This eliminates simultaneous closing of two or more valves.

According to the embodiment described, each of the pressure detectors is set to emit a valve closing signal at a lower pressure than the reduced pressure which will result when the valve concerned is opened in response to a signal from that detector as indicated in broken line in FIG. 4 so as to avoid frequent opening and closing of the valve. Stated more specifically, it is seen in FIG. 4 that the valve $V_1$ opens at gas pressure $\alpha$, resulting in reduced pressure $\beta$. If the gas flow increases in this state, the pressure increases as indicated by the arrow a, but if the gas flow reduces, the gas pressure decreases as indicated by the arrow b. In the latter case, the pressure detector $P_1$ is adapted to emit a valve closing signal at a pressure value which for example is 20 mm head lower than $\beta$, preferably at about 64 mm head.

With the control system of this invention, the valve on each branch pipe is closed in response to both a pressure signal from a detector on the preceding pipe and a valve closing signal from a limit switch on the following pipe, so that there is no need to set the pressure detectors at different valve opening or closing pressures. Thus the valves have the same ranges of pressure settings for opening and closing the valves and involve no likelihood that two or more valves will be closed at the same time. This invention therefore enables the valves to open and close stepwise free of any trouble even in the event of an abrupt or excessive variation in the load on the ground flare. Moreover, much larger quantities of waste gases can be handled than conventionally possible.

What is claimed is:

1. In a system for controlling the feed of waste gas to a ground flare comprising a plurality of branch pipes branching from a waste gas conduit and each connected to burners of the ground flare, a valve mounted on each of the branch pipes other than the first branch pipe for opening and closing the branch pipe, and a pressure detector mounted on each of the branch pipes other than the last branch pipe to feed an opening or closing signal to the valve on the following branch pipe, the improvement comprising:

means mounted on each of the valves for detecting the closing of the valve, and the valve being closable in response to both a signal from the detector on the preceding branch pipe and a signal from the valve closing detecting means on the following branch pipe.

2. A system as defined in claim 1 wherein the pressure detectors are all set at substantially the same pressure valve for emitting a valve closing or opening signal.

3. A system as defined in claim 1 or 2 wherein the pressure setting on the detector for emitting a valve closing signal is lower than the pressure resulting from the opening of the valve in response to a valve opening signal from the detector.

4. A system as defined in claim 2 wherein the pressure setting on the detector for emitting a valve opening signal is the upper limit of the pressure of gas feedable to the ground flare.

5. A system as defined in claim 4 wherein the pressure setting on the detector for emitting a valve opening signal is 950 mm head.

6. A system as defined in claim 3 wherein the pressure setting on the detector for emitting a valve closing signal is about 64 mm head.

7. A system as defined in claim 1 wherein the valve closing detecting means is a limit switch.

* * * * *